US011660649B2

(12) United States Patent
Guernsey et al.

(10) Patent No.: US 11,660,649 B2
(45) Date of Patent: May 30, 2023

(54) PRESS BRAKE SYSTEM

(71) Applicant: Accurpress America Inc., Rapid City, SD (US)

(72) Inventors: Allen Guernsey, Rapid City, SD (US); Steve Hilton, Rapid City, SD (US)

(73) Assignee: ACCURPRESS AMERICA INC., Rapid City, SD (US)

( * ) Notice: Subject to any disclaimer, the term of this patent is extended or adjusted under 35 U.S.C. 154(b) by 501 days.

(21) Appl. No.: 16/541,021

(22) Filed: Aug. 14, 2019

(65) Prior Publication Data

US 2021/0046532 A1 Feb. 18, 2021

(51) Int. Cl.

| | |
|---|---|
| ***B21D 5/02*** | (2006.01) |
| ***B21D 5/00*** | (2006.01) |
| ***B66C 5/02*** | (2006.01) |
| ***B66C 1/02*** | (2006.01) |
| ***B66C 7/00*** | (2006.01) |
| *B21D 43/14* | (2006.01) |
| *B21D 5/04* | (2006.01) |

(52) U.S. Cl.

CPC ..... *B21D 5/0281* (2013.01); *B21D 5/002* (2013.01); *B66C 1/0243* (2013.01); *B66C 5/02* (2013.01); *B66C 7/00* (2013.01); *B21D 5/004* (2013.01); *B21D 5/0209* (2013.01); *B21D 5/04* (2013.01); *B21D 43/14* (2013.01)

(58) Field of Classification Search

CPC ..... B21D 5/002; B21D 5/0281; B21D 43/10; B21D 43/105; B21D 43/11

USPC ..... 72/389.1–389.3

See application file for complete search history.

(56) References Cited

U.S. PATENT DOCUMENTS

| | | | | | |
|---|---|---|---|---|---|
| 4,084,424 | A * | 4/1978 | Roch | B21D 5/002 | 72/389.3 |
| 4,510,785 | A * | 4/1985 | Triouleyre | B21D 5/042 | 72/320 |
| 4,648,786 | A * | 3/1987 | Sakurai | B21D 43/05 | 198/468.3 |
| 5,040,404 | A * | 8/1991 | Henderson | B21D 37/14 | 72/446 |
| 5,528,818 | A * | 6/1996 | Warneke | B21D 5/042 | 228/5.1 |
| 5,761,940 | A * | 6/1998 | Moore, Jr. | B21D 5/02 | 72/19.4 |
| 2012/0279275 | A1 * | 11/2012 | Denkmeier | B21D 5/0254 | 72/389.3 |

(Continued)

FOREIGN PATENT DOCUMENTS

| | | | | |
|---|---|---|---|---|
| AT | 11415 U1 * | 8/2010 | B66C 13/12 |
| JP | 2019526452 A * | 9/2019 | B21D 5/02 |
| WO | WO-2020056437 A1 * | 3/2020 | B66C 1/0212 |

*Primary Examiner* — Shelley M Self
*Assistant Examiner* — Jared O Brown
(74) *Attorney, Agent, or Firm* — Gordon Rees Scully Mansukhani, LLP

(57) ABSTRACT

A press brake assembly including a crane system and press brake machine for processing a workpiece. The crane system having a workpiece handling mechanism configured to pick and store the workpiece. The crane system allows the crane to move along a plane via longitudinal and lateral rails. The crane also includes multiple swivel points to allow mobility to handle workpieces efficiently. The control system of the press brake machine may control the crane, allowing a single control system to control the press brake assembly.

14 Claims, 16 Drawing Sheets

(56) References Cited

U.S. PATENT DOCUMENTS

| | | | | |
|---|---|---|---|---|
| 2012/0282066 | A1* | 11/2012 | Naumann | B21D 43/105<br>414/226.05 |
| 2017/0025832 | A1* | 1/2017 | Love | B66C 1/06 |
| 2018/0133771 | A1 | 5/2018 | Hilton et al. | |
| 2019/0168477 | A1* | 6/2019 | Cleere | B66C 1/24 |
| 2019/0210083 | A1* | 7/2019 | Angerer | B21D 5/02 |

* cited by examiner

PRESS BRAKE SYSTEM

GENERAL DESCRIPTION

The application relates generally to press brake system, in particular, a press brake system with a press brake machine and a crane system.

A press brake machine or device is used as a tool to make precise bends in metal parts. Generally, a sheet of metal is placed within the machine and positioned precisely using a gauge. A punch, which often has the shape of a "V", "U", or an adjustable shape is placed against the metal sheet at the point where a bend is required. A punch is pressed into the metal sheet, which in turn is pressed into the die causing the sheet to bend. Frequently, the press brake machine is configured so that die and the punch are long enough to contact the entire length or width of the sheet.

A press brake machine may be configured so that a forming die mounted on a bed may be "U", "V" shaped, or an adjustable die. The die may include a pair of dies or half dies, for example. The distance between the dies may be adjusted so that the bearing areas for the metal part or workpiece being formed can be adjusted according to the forming requirements for the workpiece.

A crane system may be configured to place metal part or workpiece onto a track of the press brake machine. The crane may include a workpiece handling mechanism configured to retrieve and store the workpiece, in addition to adjustment of the workpiece for bending via the press brake machine. The crane is capable of unmanned autonomous operation.

A controller may be disposed on the press brake system. The controller allows the control of the press brake machine and its gauge system. The controller may additionally control the crane, allowing control of both the press brake machine, gauge system, and the crane under a single controller.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DETAILED DESCRIPTION

Various features of the present invention will be described with reference to the drawings. Like numbers are used throughout the drawings to refer to the same or similar parts and in each of the embodiments of the invention hereafter described.

A press brake system is disposed with a press brake machine and a crane. An exemplary press brake machine may include a ram located above a bed. The machine may include one or more hydraulic cylinders that force the ram (and connected tool) downward toward the bed. Alternatively, the force of hydraulic pressure may be used to force the bed upward. A press brake controller may be provided to allow for unmanned operation.

The crane is disposed above the press brake machine for retrieval and storage of material and manipulation of the workpiece for the press brake machine. The crane is controlled via the press brake controller and is capable of functioning autonomously or manually via the operator via a crane pendant. However, the crane pendant may be removed and the crane may be integrated to the press brake system to the press brake controller by having a cable from the press brake machine to connect to the crane, allowing for unmanned operation. An encoder system is also provided in the press brake controller for the rails of the crane for positioning of the crane. The crane may also include a telescoping support attached to a crane hoist. The telescoping support and crane hoist prevents the workpiece attached to the crane from swaying and providing two additional axis of control. The crane reduces time spent by the operator retrieving material and safety is increased because operator can be farther away from the press brake system while operating the press brake system.

Figure 1:
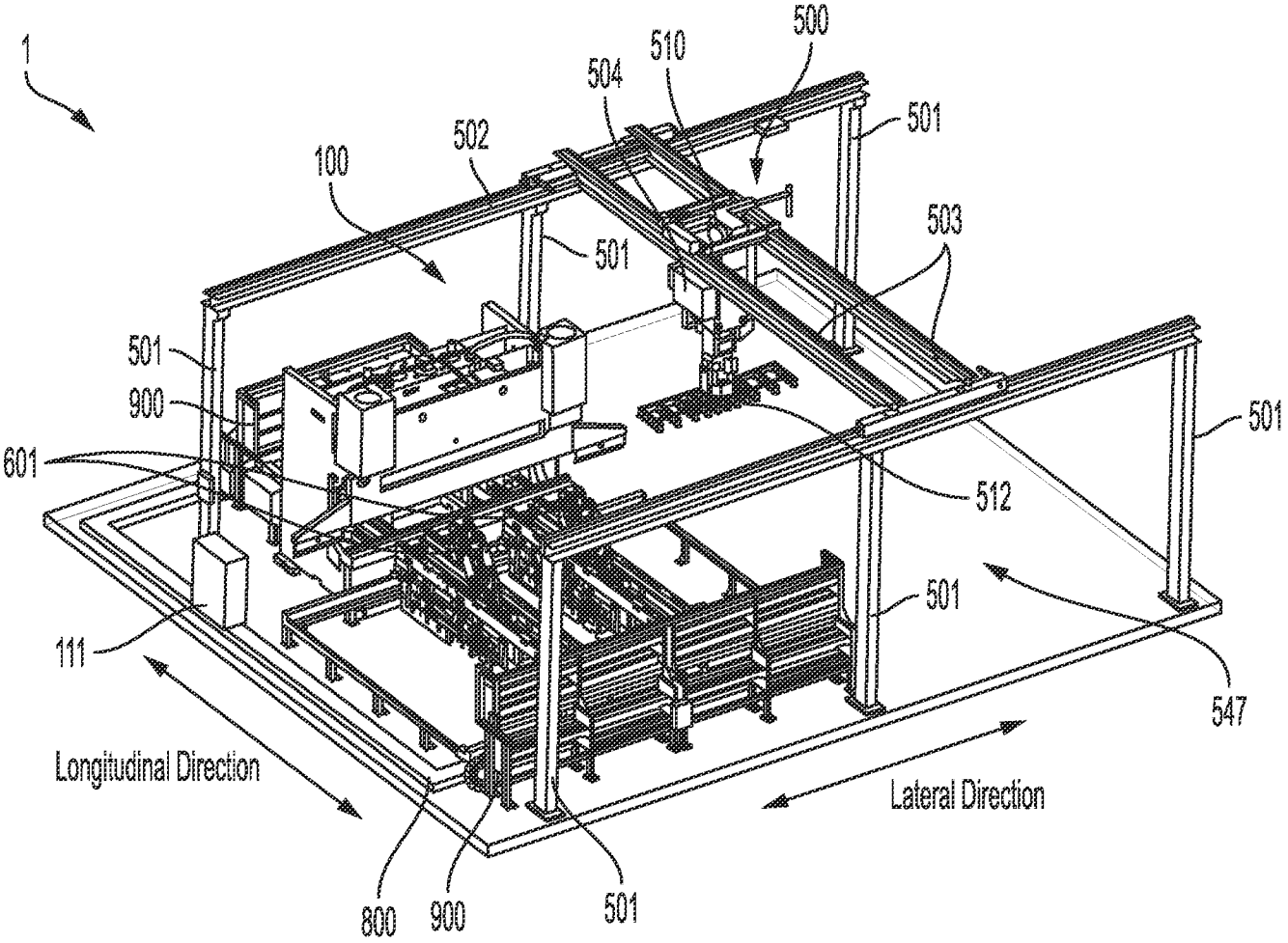
FIG. 1 is an isometric view of the press brake assembly.
Figure 2:
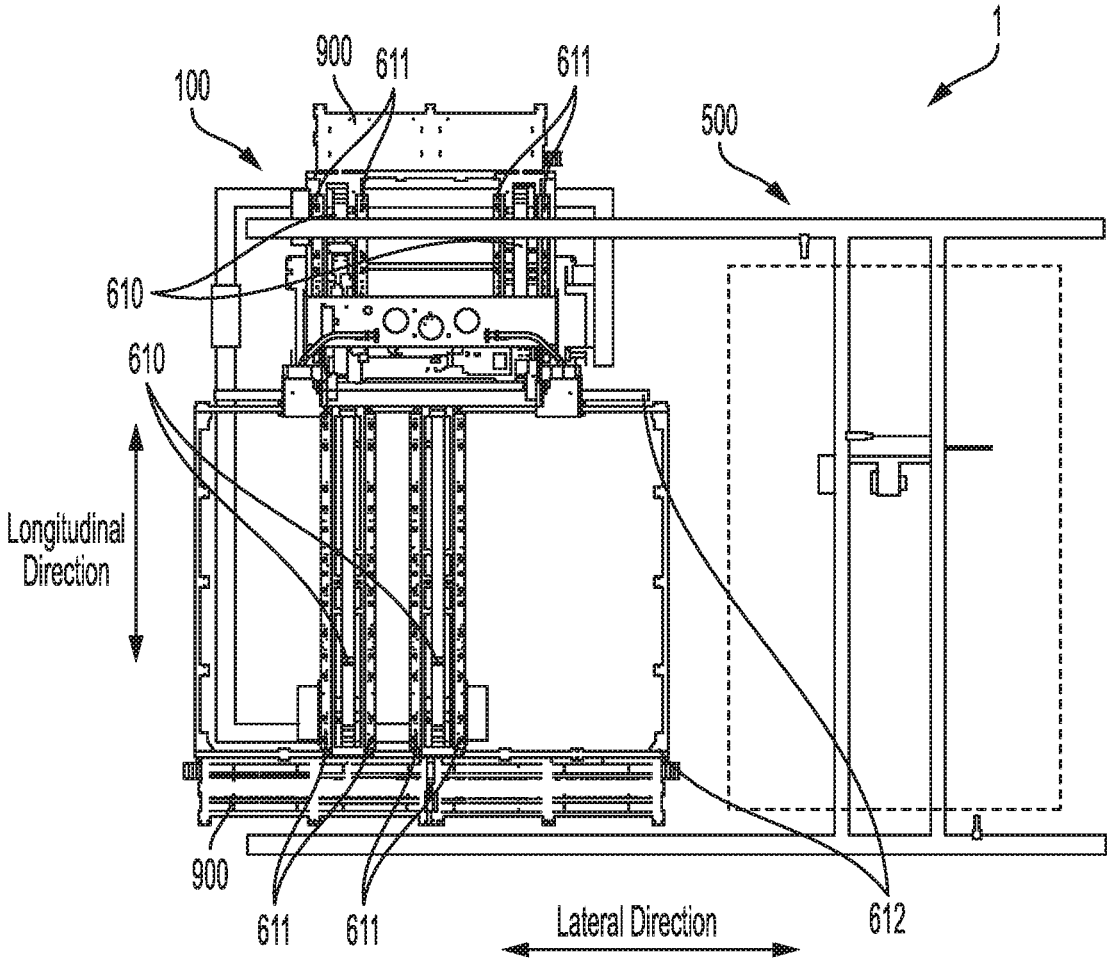
FIG. 2 is a top view of the press brake assembly.

FIGS. 1 and 2 shows a press brake system 1 comprising a press brake machine 100 and crane system 500. The crane system comprises crane supports 501 and lateral crane rails 502 in which a longitudinal crane rails 503 travels on. The lateral rails 502 allow crane 510 to move laterally relative to the press brake machine 100. The longitudinal rails 503 allow the crane to move longitudinally relative to the press brake machine 100. A crane power box 504 may be disposed on the crane 510 of the crane to supply power to the crane system 500. The crane power box 504 is separate from the power distribution box, to allow the crane system 500 to be modular and separate from the press brake machine. The crane 510 is configured to pick up and place workpieces (i.e. sheet metal) for the press brake machine 100 to bend and form from a workpiece supply area 547. After the press brake machine has processed the workpiece to the required bend and shape, the crane system 500 may place the finished workpiece to a workpiece storage area, which may be located adjacent to the workpiece supply area 547. The crane 510 includes a telescoping portion 511 which allows a workpiece handling mechanism 512 to pick up workpieces for the press brake machine at different heights. The crane system 500 may be controlled via a crane pendant (not shown). The crane pendant may be detached from the crane system 500, and a controller of the press brake system 100 may be connected to the crane system 500. The controller may comprise an encoder system such that it is capable of controlling the kinematics of rails 502 and 503 and the crane 510. This allows a user to control the crane 510 and press brake machine 100 under one control unit/display. The controller also capable of an autonomous mode allowing for unmanned operation. The user may set the controller through the controller display (not shown) to preset a desired bend/shape for the autonomous mode.

A press brake machine 100 is disposed in order to bend and shape the workpiece. A power distribution box 111 is disposed adjacent to the press brake machine. The power distribution box 111 distributes power to press brake system via trench 800. Cables (not shown), lie inside and across the trench and are connected to the parts that require power. The press brake machine disclosed herein is used to bend or otherwise deform sheet-like workpieces, such as sheet metal workpieces. The press brake is controlled via the press brake controller. The controller may be operated manually by a user or autonomously in an unmanned operation. Unmanned operation of the press brake system is aided by the forward 601 and back gauges 602 (not shown; behind press brake machine 100) of the press brake system. These gauges 601, 602 may utilize the system disclosed in U.S. Published Patent Application No. 2018/0133771, Ser. No. 15/814,518 filed on Nov. 15, 2017 (incorporated by reference herein in its entirety).

Forward gauges 601 are placed upstream of the press brake machine 100, where the workpiece enters the press brake machine 100. Forward gauges 601 are configured to aid in the bending and shaping of the workpiece. The forward gauge includes robotic arms with clamps, capable of moving and rotating in seven axes. The back gauges (not shown), are disposed aft of the press brake machine 100, and may also be configured to aid in the bending and shaping of the workpiece and is capable of moving and rotating in seven different axes. Both the back and forward gauges may be changed to accommodate handling workpieces of different sizes. Both the back gauge and forward gauge 601 may also change the die and punch of the press brake machine.

Tool racks 900 are disposed in the press brake system. The tool rack 900 is disposed both rear and forward of the press brake machine 100. The tool rack is configured to organize and hold tools (e.g. punches and dies) for the press brake machine. The clamps of the gauge system may aid the press brake system by locating and retrieving punches and dies from the tool rack and installing them into the press brake machine. The clamps also store the punches and die to the tool rack from the press brake bed for storage. The gauge system with clamps works to aid in both forming the material and management of tools in the system. The gauging system provides one device capable of both functions of aiding in bending/shaping the material and installing/storage of tools. The tool racks 900 are disposed on the ends of longitudinal gauge rails 610. Power tables 611 are disposed along the longitudinal gauge rails 610 in order to support the material at proper heights.

The longitudinal gauge rails 610 guide gauges 601/602 to traverse longitudinally along corresponding guide rails 610 to install, store, or retrieve tools for the press brake machine 100 from the tool rack 900. Lateral guide rails 612 are also disposed to allow lateral movement along the press brake system.

Figure 3:
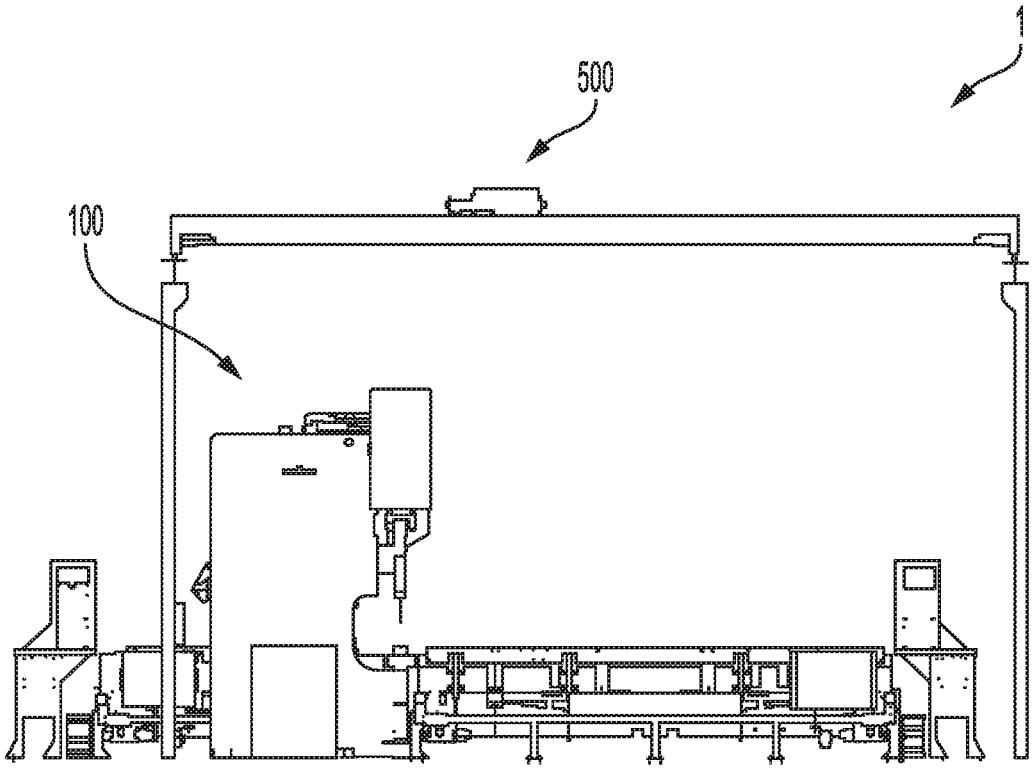
FIG. 3 is a side view of the press brake assembly.

FIG. 3 show a side view of the press brake system 1. Locations of crane system 500 and press brake machine 100 are not fixed and may be placed anywhere as long as the crane system 500 is capable of having full range of motion in the work space of the press brake machine 100 and is also capable of retrieving and storing workpieces as required.

Figure 4A:
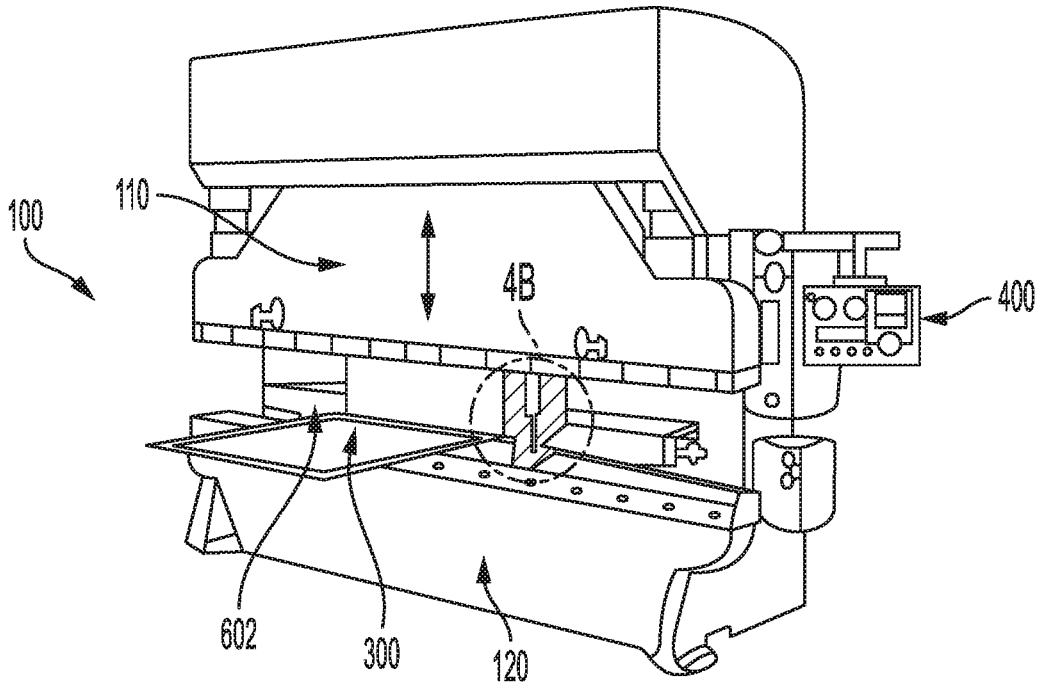
FIG. 4A is an exemplary press brake machine of the press brake assembly.

As shown in FIG. 4A, a press brake machine 100 has an upper beam or ram 110 and a lower beam or bed 120, at least one of which is movable toward and away from the other. Preferably, the upper beam is movable vertically while the lower beam is fixed in a stationary position. As an example, a male forming punch and a female forming die may be mounted respectively on the upper and lower beams of a press brake. A rear gauge 602 is shown holding the workpiece 300 in place while the punch is pressed.

Figure 4B:
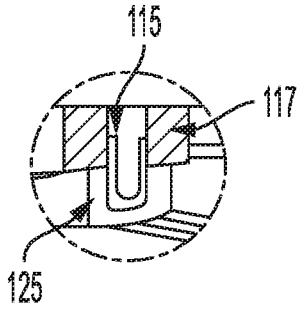
FIG. 4B is close up of the exemplary press brake machine.

As shown in the close up view of FIG. 4B, the punch 115 projects downward into the die 125. The press brake may also include an optional pressure pad 117 for holding the workpiece 300 while the bending operation occurs. The rear gauge 602 is capable of replacing the punch 115 and die 125 to allow for forming of different shapes and bends. The rear gauge 602 provides an automatically positioned stop to assist in positioning workpieces between the dies of the press brake. The exemplary die and punch combination shown is a "U" die, however other shapes such as a "V" die may be used. Furthermore, a rear gauge 602 is shown in the figure, however a forward gauge 601 may also be utilized.

The press brake may include a controller 400 for controlling the bending of the workpiece and/or the movement of the various parts of the press brake, including the gauge disclosed herein. The controller may be configured to adjust the position along ten or more axis of motion. The use of a controller on the press brake provides for reduced time and improved efficiency of bending operations for even relatively simple bending of parts that include only two or three bends and for lots of parts that only include two or three parts.

The controller may include a display that, for example, provides the user with a graphical representation of the formed part in a simple to use format. The user may input various information such as, for example, the material type, thickness, length and describing the bends and flange lengths. The controller may be configured to set the positions and speeds of all the axis of the machine. Thus, the controller reduces the setup time and operator experience required for bending various parts. In addition, the use of the controller may reduce the amount of scrap material that remains after the bending operation. The majority of controllable axis are found in the gauge portion of the press brake which may include two or more clamps located at the end of an arm which may grasp a workpiece and act as material stops and supports which allow for accurate gauging (i.e., positioning) of workpieces.

It is advantage to use a movable gauge for the manufacture of parts which require different gauge positions. Also, a programmable gauge enables an operator to perform several operations with the same tooling. The programmable gauge is programmed to move the clamps of the gauge to the desired positions for each of the forming operations. Thus, the controller preferably includes software that a user may interface with, via the display or keyboard for example, to control forming operations of the workpiece. The programmable rear and forward gauges are also capable of changing the tool during operation to accommodate for different bends and shapes. The rear and forward gauges act as a tool changer and are also capable of storing tools in the tool rack.

An advantage associated with the use of programmable gauges is that they greatly increase the number of forming operations that may be performed on a single press brake without having to change the setup. The ability of the clamps to remove the workpiece out of position (or to a new position) between bending operations, eliminates the requirement for the operator to move the workpiece between forming operations. The gauge may be programmed to move the clamps to the longitudinal position along the bed of the press brake where the operator will perform the next operation on the part. As a result, the clamps are accurately and automatically positioned. The gauge may additionally be programmed such that either the forward or rear gauges may engage in a fully unmanned operation during the pressing operation.

Figure 5:
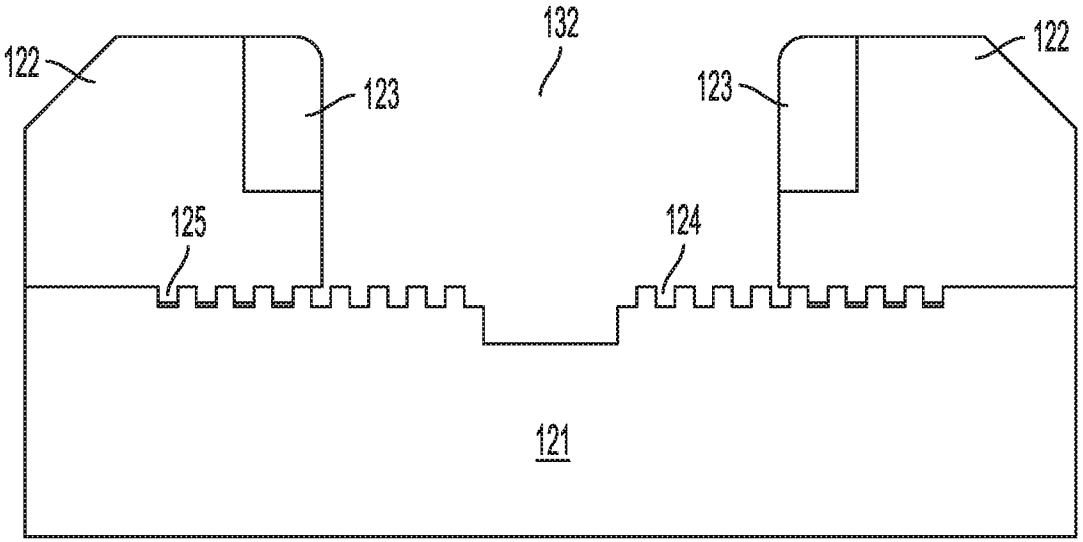
FIG. 5 is an exemplary lower bed of the press brake machine with an exemplary adjustable die.
Figure 6:
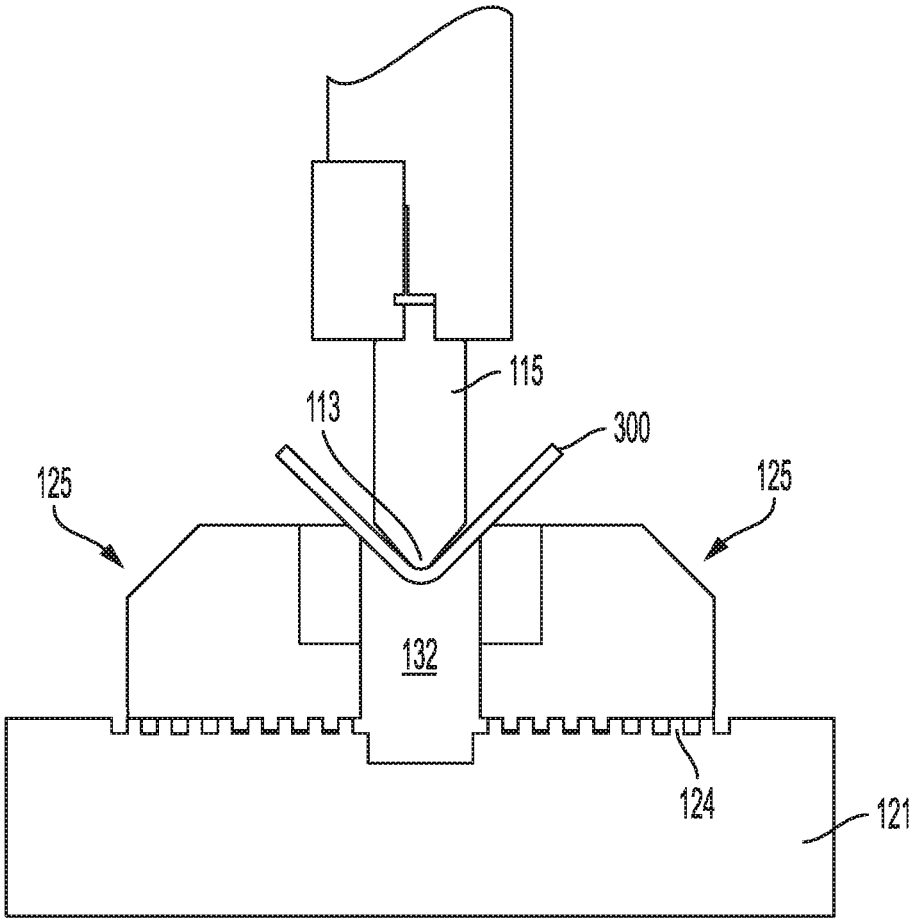
FIG. 6 is an exemplary lower bed of the press brake machine during a bending operation with an exemplary adjustable die.

FIGS. 5 & 6 shows the lower beam or bed 120 with an exemplary adjustable die. The punch 115 has a downwardly-oriented, work piece-deforming surface (or "tip") 113. The configuration of this surface is dictated by the shape into which it is desired to deform a work piece 300. The die has a recess 132, bounded by one or more work piece-deforming surfaces 113, that is aligned with the tip of the punch. The configuration of this recess 132 corresponds to the configuration of the punch's tip. Thus, when the beams are brought together, a work piece 300 between them is pressed by the punch into the die to give the work piece a desired deformation (e.g., a desired bend).

The lower beam or bed 120 may include a base plate 121 that supports a movable upright or riser 122. The upright 122 may carry an insert 123 positioned to contact the work piece during the bending operation. The upright 122 and insert 123 together form a die member 126 that may be adjustable to meet the requirements of the bending operation. The top surface of the base plate 121 may be a saw toothed or grooved surface 124 for engaging the bottom surface of the movable die. The bottom surface of the upright 122 may be a corresponding saw toothed or grooved surface 126 for interlocking and engaging the top surface 124 base plate 121. As shown in the figures, the press brake includes a pair of die members 125 (that together form a die 125) and a corresponding punch 115 that moves downwardly between the die members 125 to bend the work piece 300. The relative separation between the die members 125 can be adjusted when the uprights 122 are unlocked from the base plate 121. The die members 125 and punch 115 may be changed via forward and rear gauges. For example, after forward and rear gauges position and hold the workpiece in place, the press brake will punch the workpiece to form a bend. The forward and rear gauges then may store the die and/or punch into the tool rack and retrieve a new die and/or punch to install in order to perform the specified bend required by the controller.

Figure 7:
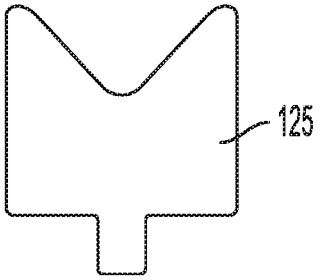
FIG. 7 is the front side view of the press brake machine.
Figure 8:
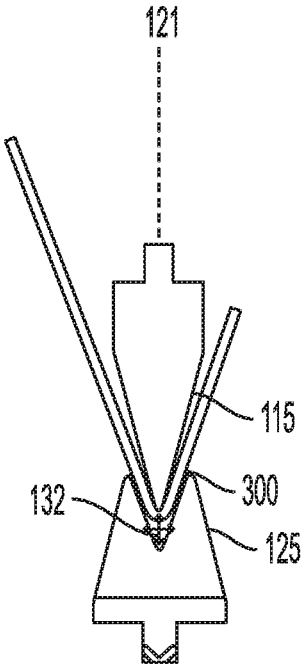
FIG. 8 is the rear side view of the press brake machine.

FIGS. 7 and 8 show an exemplary "V" die which may be used instead of the adjustable die shown in FIGS. 5 and 6. The "V" die has die member 125 with material 300 being punched in the recess 132 of die member 125.

Figure 9:
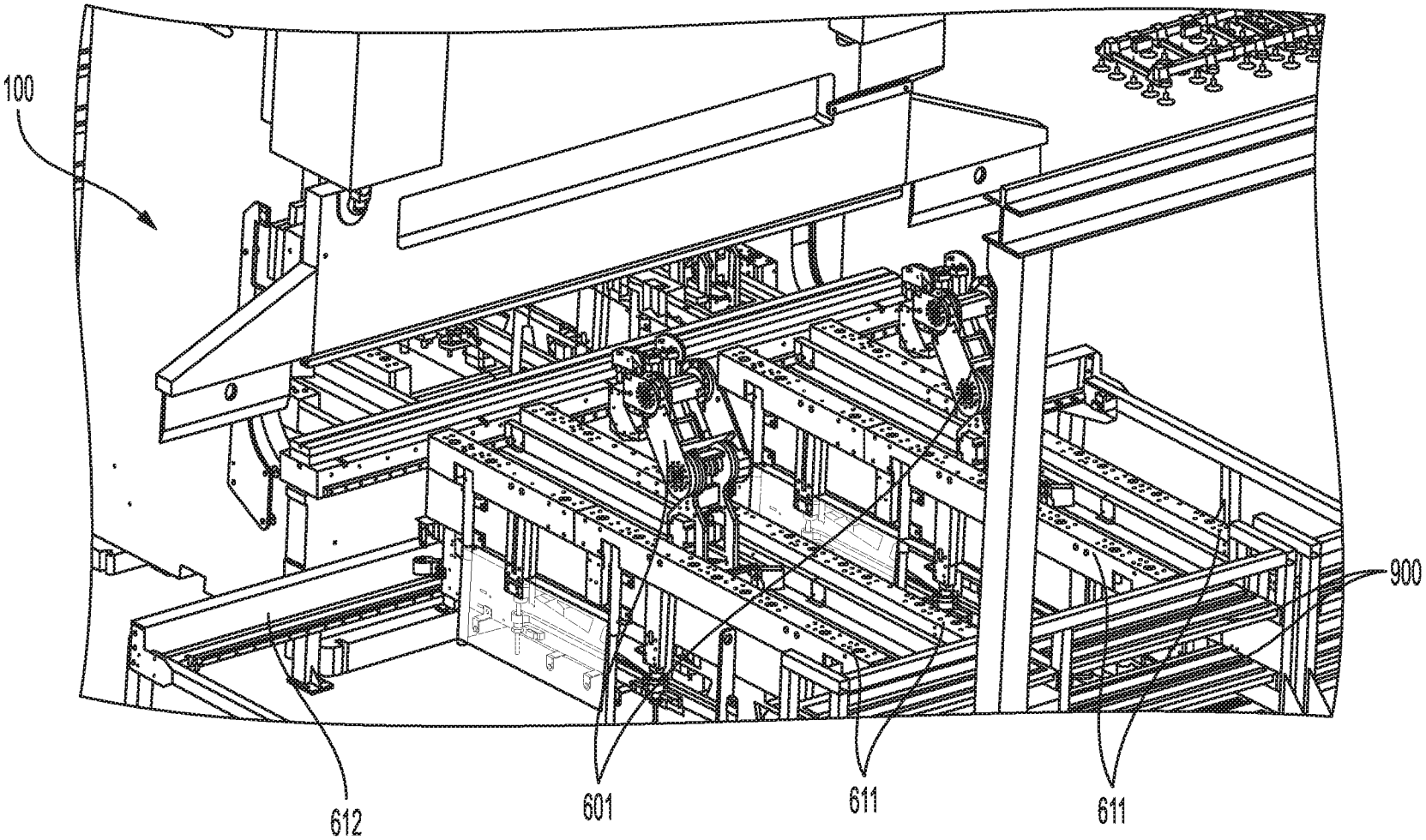
FIG. 9 is the front side view of the press brake machine.
Figure 10:
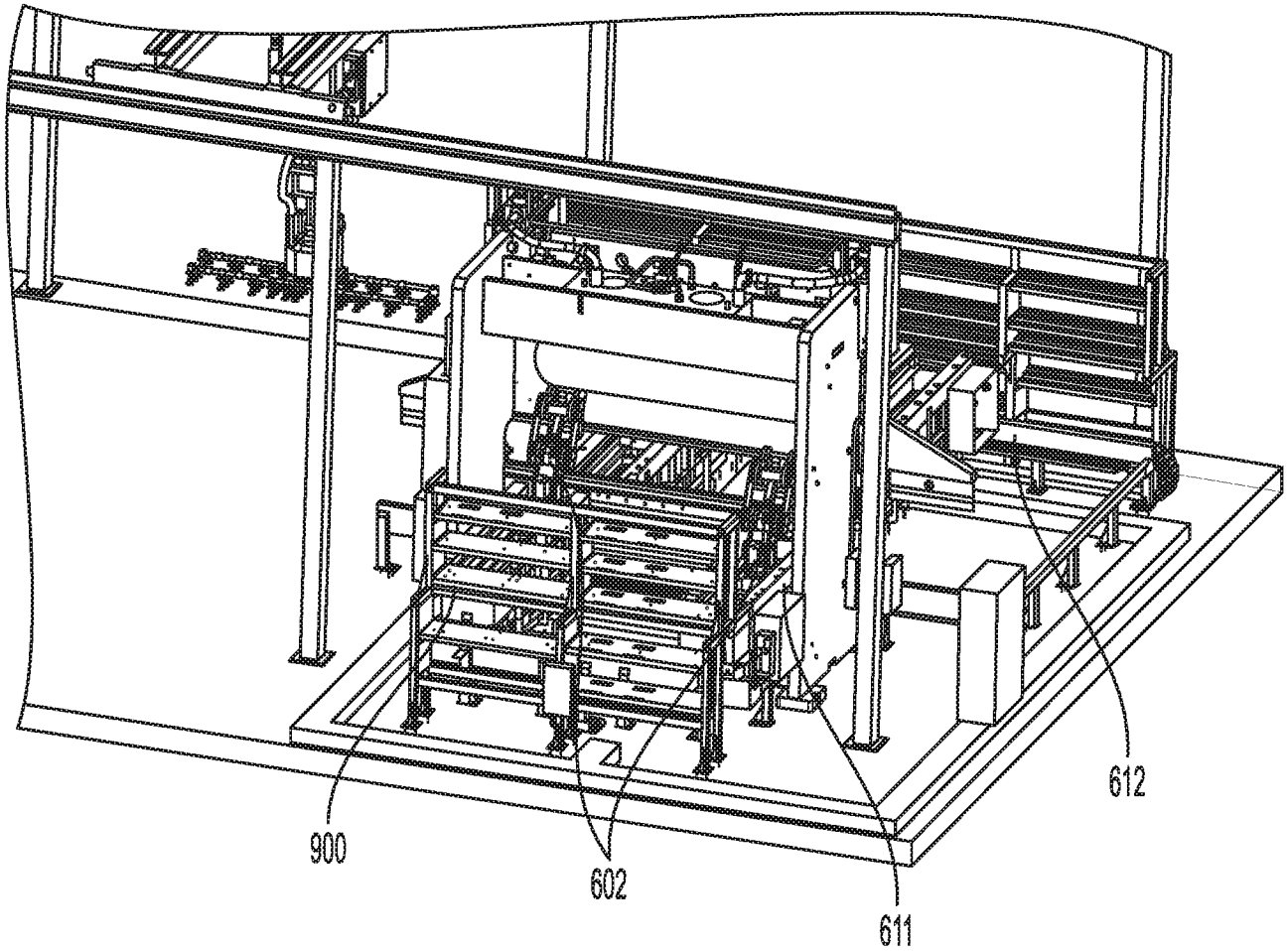
FIG. 10 is the rear side view of the press brake machine.

FIGS. 9 and 10 respectively show the forward and rear of the press brake machine. In the exemplary embodiment shown, a set of two forward gauges 601 and two rear gauges 602 are disposed forward and rear of the press brake machine respectively. While two sets of two gauge are shown, the press brake assembly may include any number of gauges such as comprising only one rear or forward gauge, or one rear and one forward gauge. Tool racks 900 are disposed adjacent to the gauges an are disposed on both rear and forward sides. Gauge rails 610 are placed to guide gauges 601 and 602 in the longitudinal direction. However, lateral guide rails may also be placed to allow gauges 601 and 602 to traverse sideways. Power tables 611 are disposed along the gauge rails 610 in order to support the material at proper heights.

Figure 11:
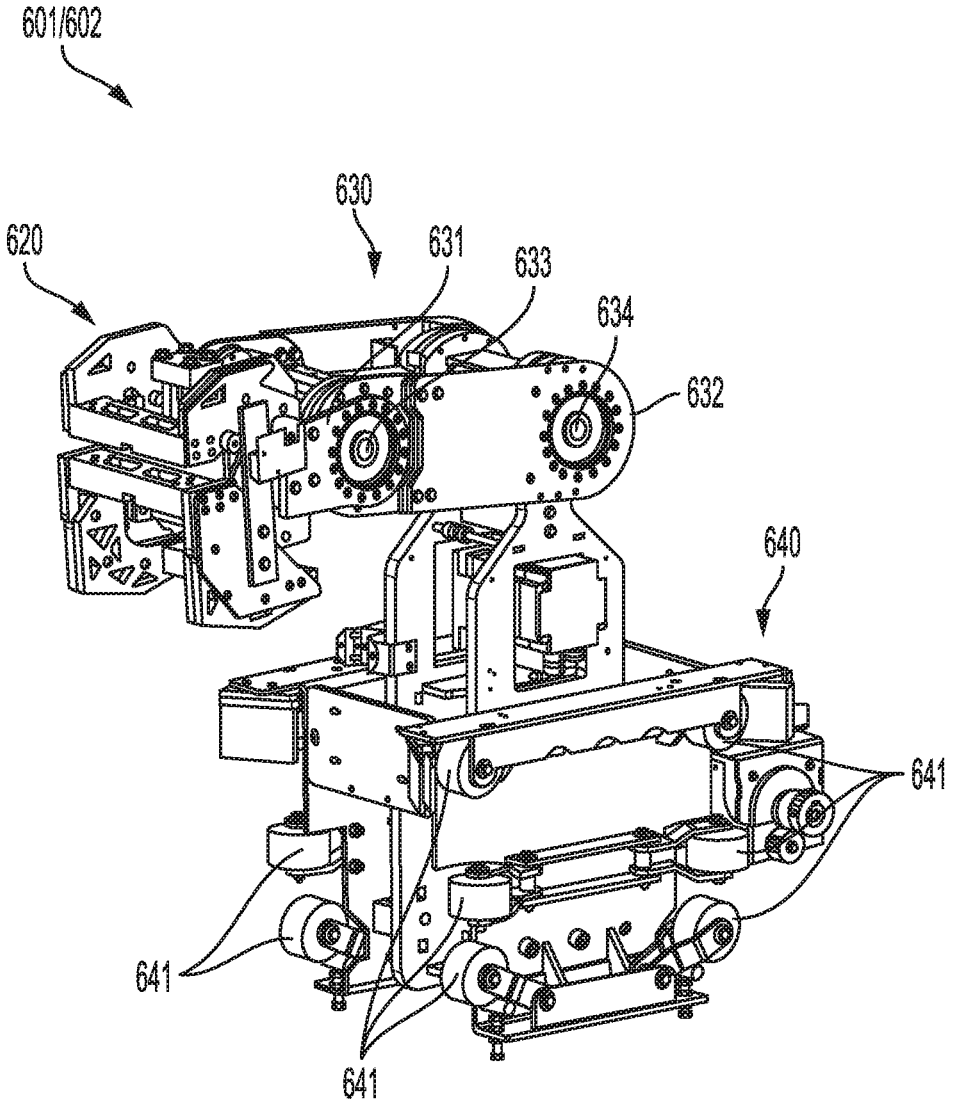
FIG. 11 is an isometric view an exemplary gauge of the press brake assembly.
Figure 12:
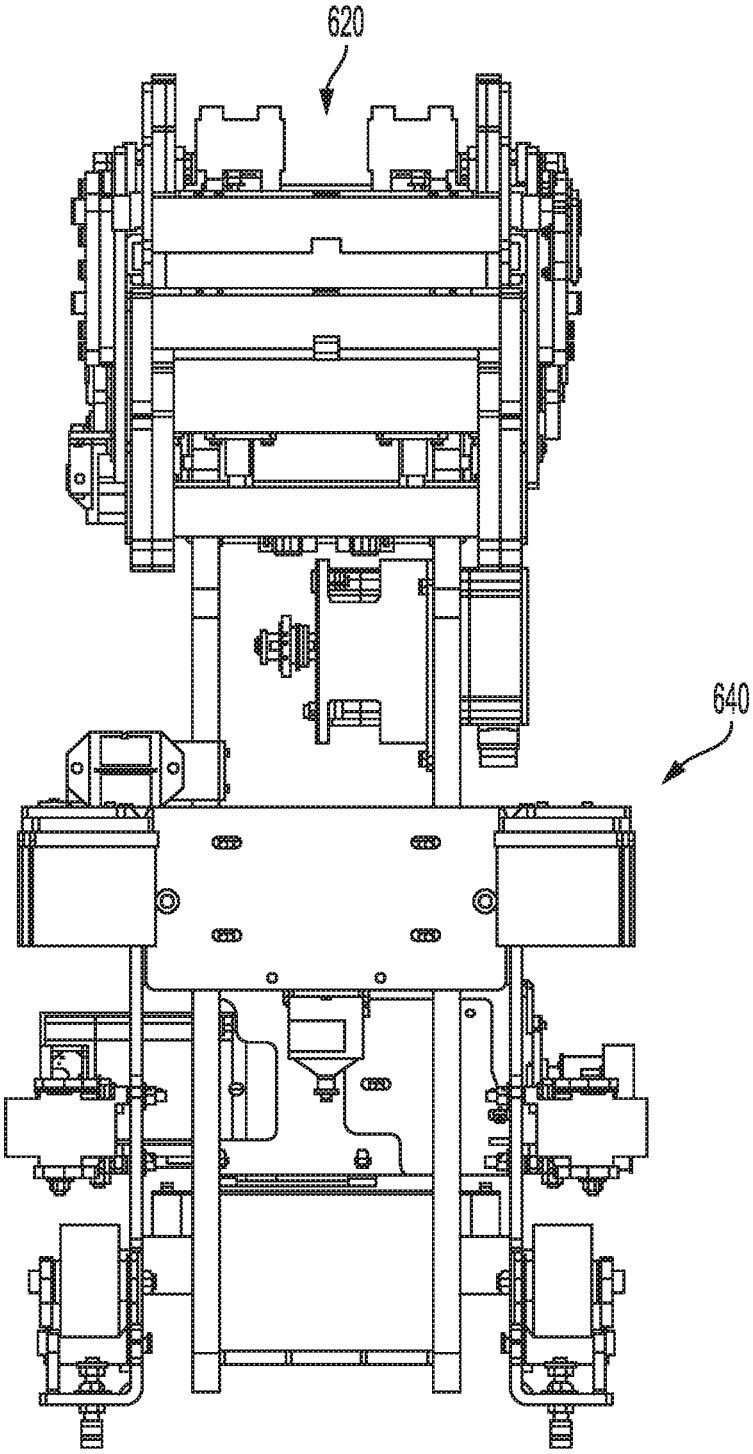
FIG. 12 is a front view of the gauge.
Figure 13:
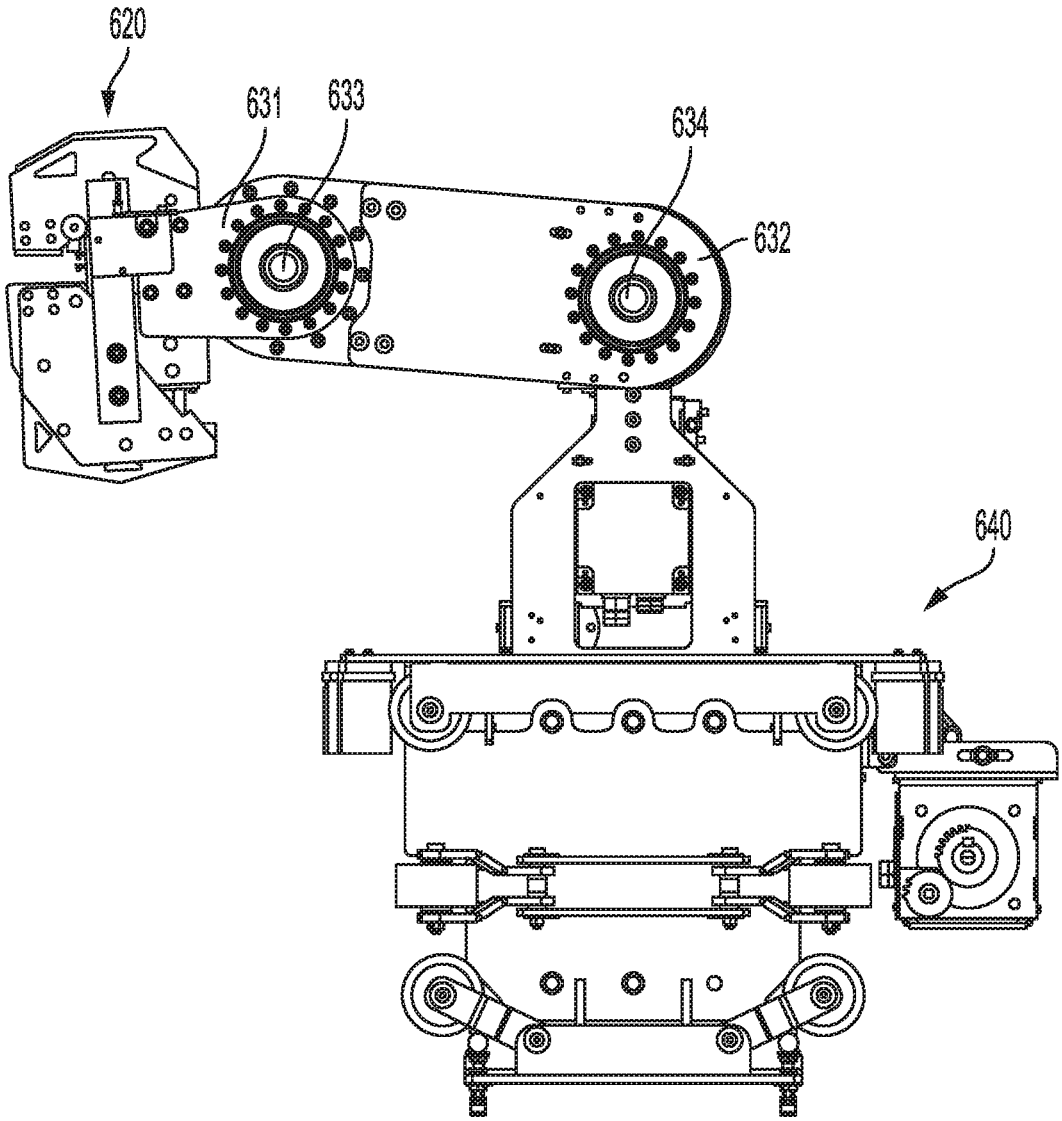
FIG. 13 is a side view of the gauge.
Figure 14:
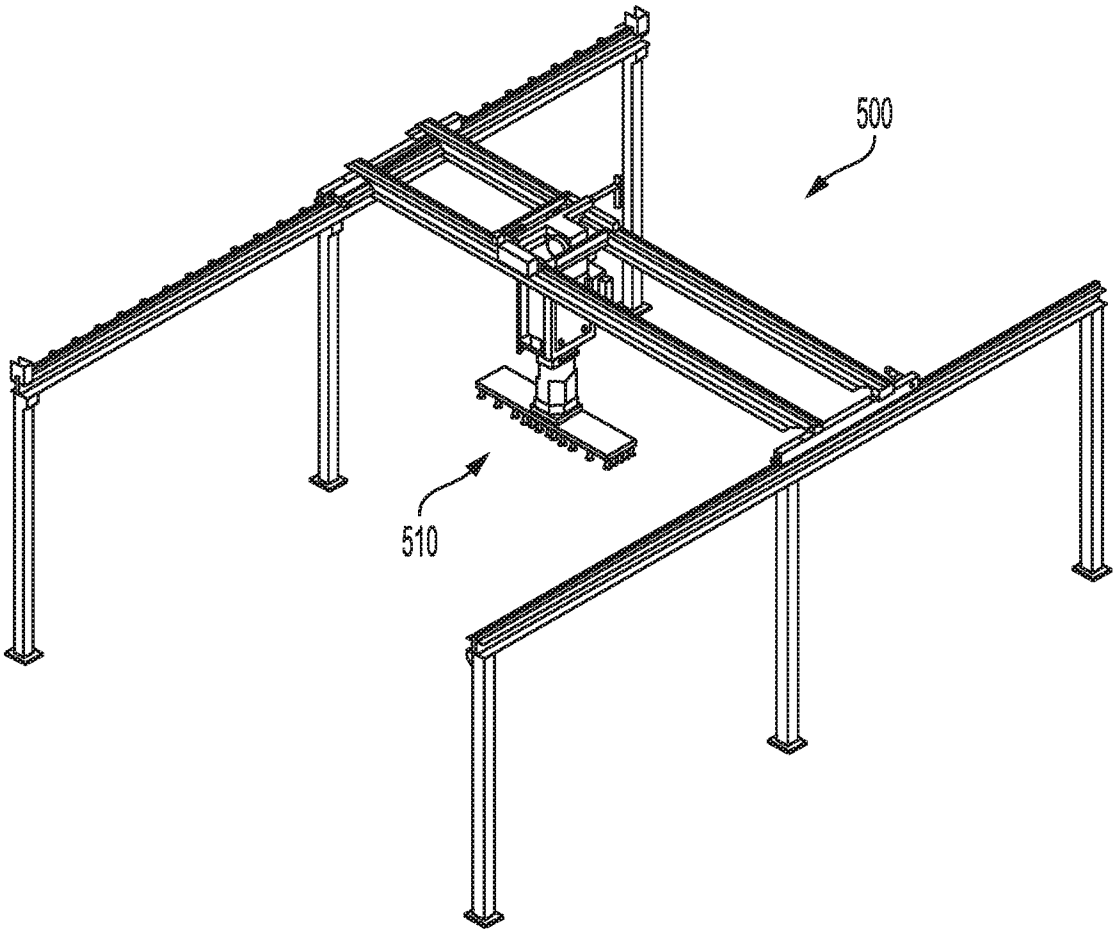
FIG. 14 is an isometric view of the crane system.
Figure 15:
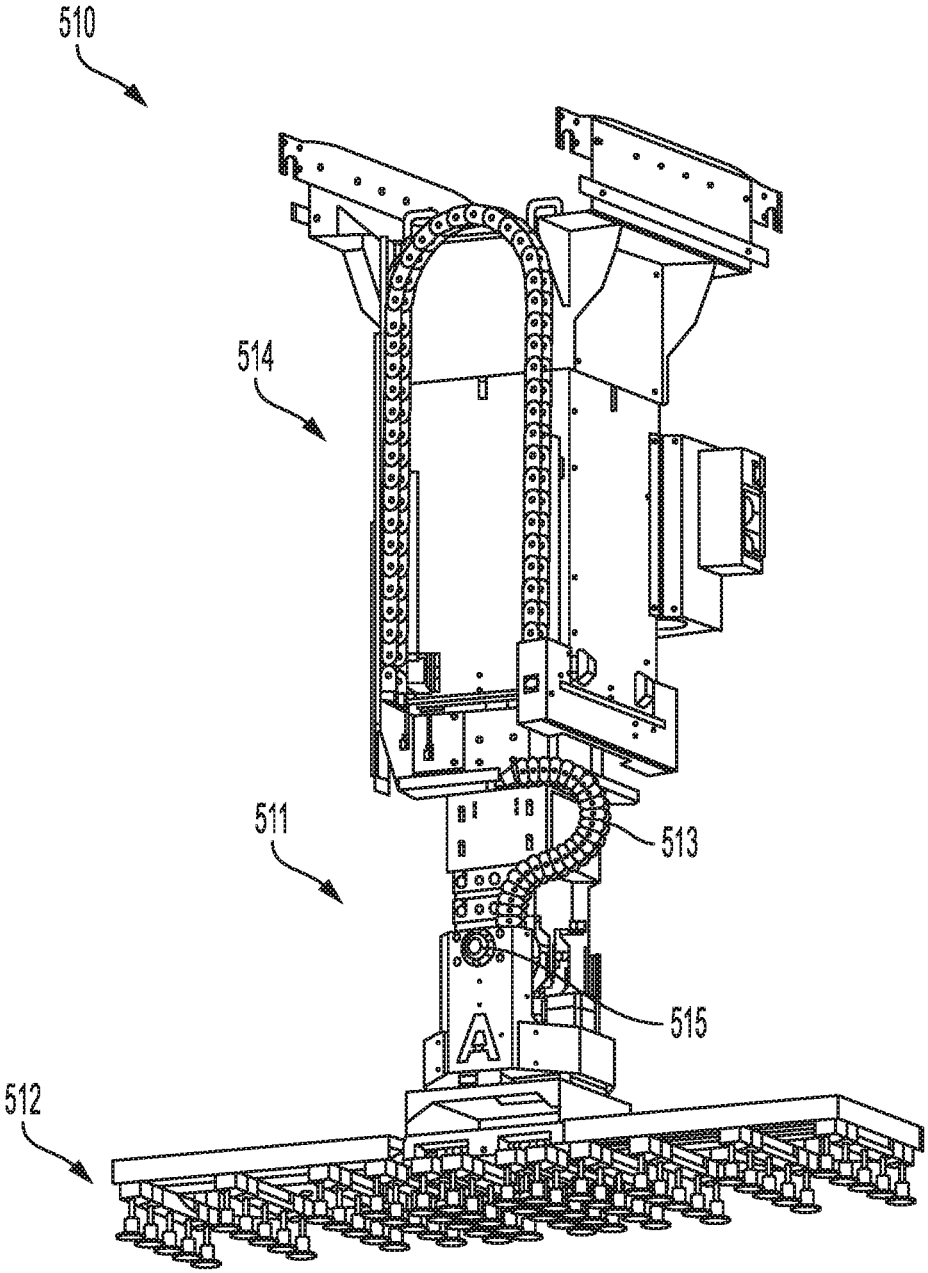
FIG. 15 is an isolated isometric view of the crane.
Figure 16:
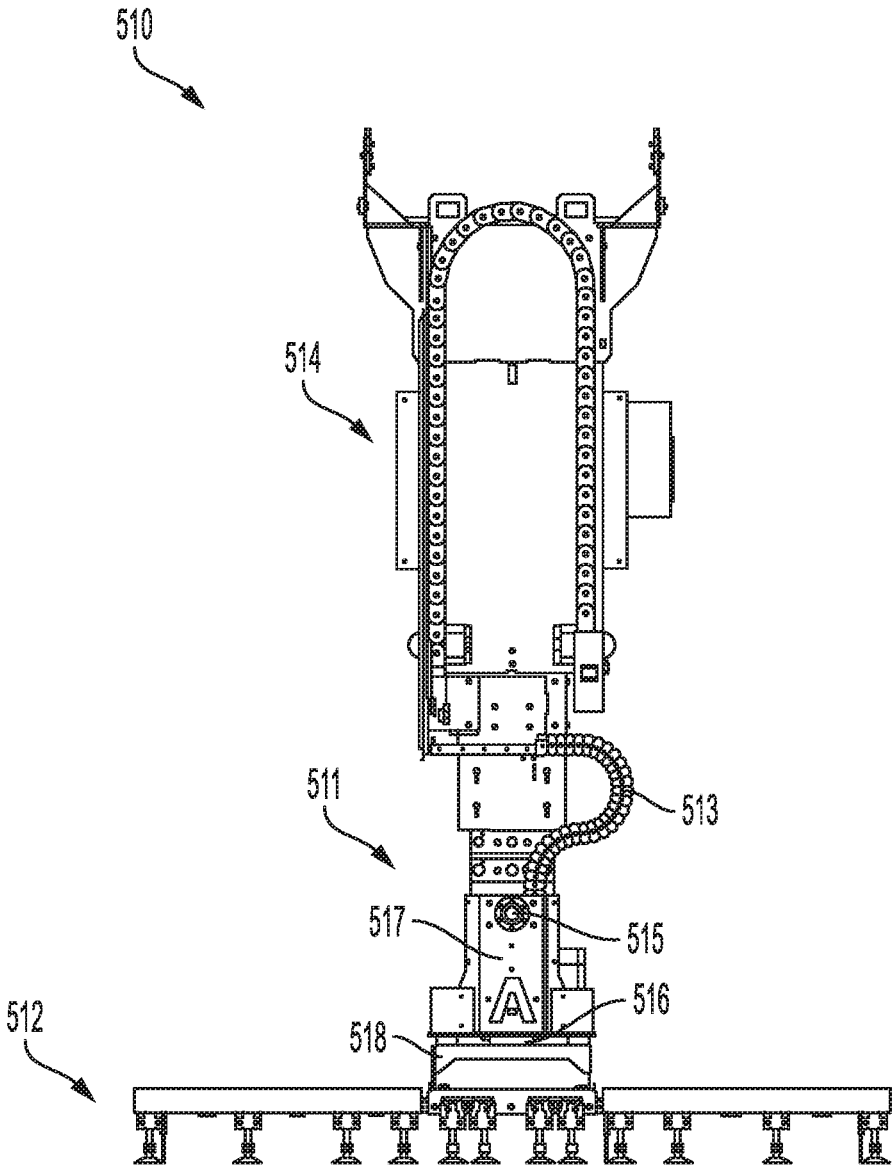
FIG. 16 is a side view of the crane system.
Figure 17:
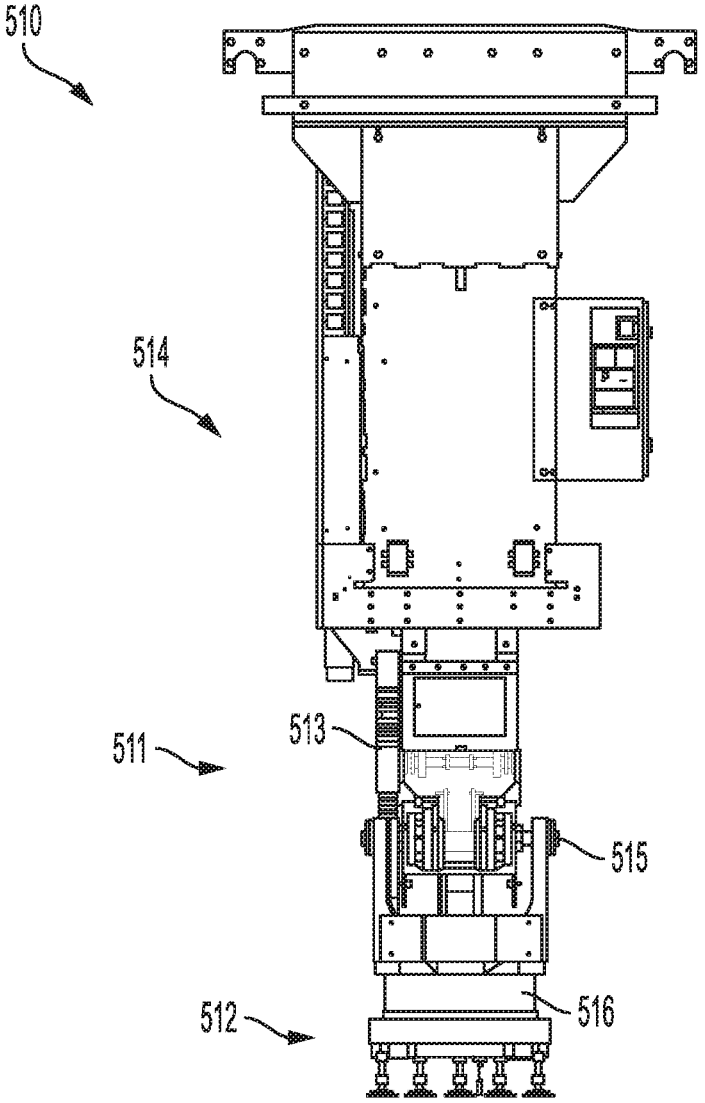
FIG. 17 is a front view of the crane system.

FIGS. 11-13 shows an isolated gauge 601/602. The gauge comprises a gauge clamp 620, a gauge arm portion 630, and a supporting frame portion 640. The gauge clamp 620 allows the gauge to grasp the workpiece and the tools for the press brake machine. The exemplary gauge arm portion 630 comprises a first 631 and second 632 swivel arms and disposed on first and second swivels 633 and 634 respectively. The swivels allow the gauge to have the mobility to grab the different tools and work pieces and allows the gauge to rotate and move the workpiece to the required positions. The exemplary gauge arm shown contains two rotation axes at the corresponding swivels 633/634. More arms and swivels may be placed to allow for more complex kinematics to allow better mobility for the gauges for even more complex movements. Each swivel comprises an internal motor (not shown) which rotate the arms around the swivel. Rollers 641 are disposed on the frame to allow movement of the gauge along the gauge guide rails. The controller 400 of the press brake machine 100 controls the position and movement gauges 601/602 in the autonomous unmanned mode or an operator of the press brake machine may manually control the gauges.

FIGS. 14-17 shows the crane system 500 and crane 510. The crane system 500 comprises its own power supply and may be modular to the press brake machine, allowing it to operate separately. The crane 510 is configured to pick up and place workpieces (i.e. sheet metal) for the press brake machine 100 to bend and form. The crane 510 includes a telescoping portion 511 which allows the workpiece handling mechanism 512 to pick up workpieces for the press brake machine at different heights. The exemplary workpiece handling mechanism 512 contain suction cups that attach to the workpiece, however other mechanisms may be used such as clamps or magnets. The crane system 500 may be controlled via a crane pendant (not shown). The crane pendant may be detached from the crane system 500, and a controller 400 of the press brake system 100 may be connected to the crane system 500.

The telescoping portion 511 is attached to a crane body 514 via a tether 513. The telescoping portion may be coaxial with the crane body 514 and is configured to travel along the longitudinal axis of the crane body 514. The electrical umbilical 513 provides electrical connections to the crane 510 needed to operate the crane functions. Crane body 514 may contain internal stops (not shown) to prevent structural failure in the telescoping portion 511. The telescoping portion 511 may also swivel on a first crane swivel 515 attached to a first crane swivel arm 517, and a second crane swivel 516 attached to a second crane swivel arm 518. The swivels and corresponding arms allow mobility for the crane to pick and store workpieces and also aid in the positioning of the workpiece for bending for the press brake machine. The axes of rotation for the first 515 and second swivel 516 are perpendicular relative to each other. The press brake machine controller 400 may control the crane system 500 in tandem with the press brake machine 100 and its gauges 601/602. Thus the press brake machine 100, gauges 601/602, and crane system 500 are in cooperative communication with each other, meaning that data from press brake machine 100, gauges 601/602, and system 500 is a variable relative to each other, monitored by a single control system 400.

Thus, as described above, the press brake system disclosed herein allows for bends to be formed on opposite sides of a sheet of metal without the operator having to remove the workpiece or sheet from the press brake machine via gauges. The gauges also provides for movement of the workpiece according to various different axes in order to position the workpiece properly for bending. The gauge system is further capable of changing the tool of the press brake machine to allow processing of large variations of shapes and bends of the workpiece. The system additionally allows the workpiece to be moved between the press brake machine, supply location, and storage location via the crane system. All of the combined system described above under a single controller allows for a fully autonomous unmanned operation of the press brake system.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to any precise numerical ranges provided. Accordingly, these terms should be interpreted as indicating that insubstantial or inconsequential modifications or alterations of the subject matter described are considered to be within the scope of the invention.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "fore," "aft," "inboard," "outboard," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the press brake system shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A press brake assembly comprising:

a press brake machine configured to process a workpiece;

a crane system including a crane with a crane body, wherein the crane is configured to carry the workpiece into a position to be worked on by the press brake machine;

a movable gauge configured to position the workpiece adjacent the press brake machine;

wherein the crane is configured to move in directions to carry the workpiece to positions located both fore and aft of the press brake machine a controller configured to control the movement of the press brake machine, the crane, and the gauge to process the workpiece;

wherein the crane comprises a telescoping portion, wherein the telescoping portion is configured to move along a longitudinal axis of the crane body;

wherein the telescoping portion comprises a first arm configured to rotate about a first axis parallel to the longitudinal axis of the crane body;

wherein the telescoping portion comprises a second arm located at the base of the telescoping portion and configured to rotate about a second axis perpendicular to the first axis;

wherein the first axis and the second axis intersect; and wherein the crane comprises a workpiece handling mechanism attached to the second arm.

2. The press brake assembly of claim 1, wherein the workpiece handling mechanism comprises suction cups configured to selectively attach to the workpiece.

3. The press brake assembly of claim 1, wherein the workpiece handling mechanism comprises a clamp configured to selectively attach to the workpiece.

4. The press brake assembly of claim 1, further comprising a tether connected to the first arm and the crane body.

5. The press brake assembly of claim 1, wherein the crane system further comprises a plurality of crane supports configured to suspend the crane.

6. The press brake assembly of claim 5, wherein the crane system further comprises a lateral rail suspended by the crane supports, wherein the lateral rail is configured to guide the crane to move in a lateral direction relative to the press brake machine.

7. The press brake assembly of claim 5, wherein the crane system further comprises a longitudinal rail suspended by the crane supports, wherein the longitudinal rail is perpendicular to the lateral rail and is configured to guide the crane to move in a longitudinal direction relative to the press brake machine, wherein the longitudinal direction is perpendicular to the lateral direction.

8. A press brake assembly including a press brake and a crane system, the crane system comprising:

a crane comprising a crane body;

a plurality of crane supports configured to suspend the crane;

a lateral rail suspended by the crane supports, wherein the lateral rail is configured to guide the crane to move in a lateral direction;

a longitudinal rail suspended by the crane supports, wherein the longitudinal rail is perpendicular to the lateral rail and is configured to guide the crane to move in a longitudinal direction, wherein the longitudinal direction is perpendicular to the lateral direction; and wherein the crane comprises a telescoping portion, wherein the telescoping portion configured to move along a longitudinal length of the crane body;

wherein the telescoping portion comprises a first arm configured to rotate about a first axis parallel to the longitudinal axis of the crane body;

wherein the telescoping portion comprises a second arm located at the base of the telescoping portion and configured to rotate about a second axis perpendicular to the first axis; and wherein the first axis and the second axis intersect; and wherein the crane is configured to move in directions to carry the workpiece to positions located both fore and aft of the press brake machine.

9. The assembly of claim 8, wherein the crane system is controlled by a controller of the press brake.

10. The assembly of claim 8, wherein the crane comprises a workpiece handling mechanism attached to the second arm.

11. The assembly of claim 10, wherein the workpiece handling mechanism comprises suction cups configured to selectively attach to the workpiece.

12. The assembly of claim 10, wherein the workpiece handling mechanism comprises a clamp configured to selectively attach to the workpiece.

13. The assembly of claim 8, further comprising a tether-connected to the first arm and the crane body.

14. A press brake assembly comprising:

a press brake machine configured to process a workpiece;

a crane system comprising a crane with a crane body, wherein the crane is configured to carry the workpiece for the press brake machine;

a plurality of gauges configured to position the workpiece for the press brake machine, wherein at least one gauge of the plurality of gauges is located aft of the press brake machine and at least one other gauge of the plurality of gauges is located forward of the press brake machine; and a controller configured to control the press brake machine, the crane, and the plurality of gauges to process the workpiece;

wherein the crane comprises a telescoping portion, wherein the telescoping portion is configured to move along a longitudinal axis of the crane body;

wherein the telescoping portion comprises a first arm configured to rotate about a first axis parallel to the longitudinal axis of the crane body; and wherein the telescoping portion comprises a second arm located at the base of the telescoping portion and configured to rotate along a second axis perpendicular to the first axis; and wherein the first axis and the second axis intersect; and wherein the crane is configured to move in directions to carry the workpiece to positions located both fore and aft of the press brake machine.

* * * * *